US008328507B2

(12) United States Patent
McCaffrey

(10) Patent No.: US 8,328,507 B2
(45) Date of Patent: Dec. 11, 2012

(54) KNIFE EDGE SEAL ASSEMBLY

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 488 days.

(21) Appl. No.: 12/466,978

(22) Filed: May 15, 2009

(65) Prior Publication Data

US 2010/0290898 A1 Nov. 18, 2010

(51) Int. Cl.
*F01D 25/08* (2006.01)
*F01D 11/02* (2006.01)

(52) U.S. Cl. ..... 415/173.7; 415/177; 415/180; 415/230

(58) Field of Classification Search ..... 415/173.1, 415/173.5, 173.7, 174.3, 177, 178, 180, 230; 277/411, 412, 418
See application file for complete search history.

(56) References Cited

U.S. PATENT DOCUMENTS 1,792,288 A 2/1931 Dempster
3,056,579 A * 10/1962 Bobo ..... 416/96 R
3,067,490 A 12/1962 Luthy et al.
3,295,825 A 1/1967 Hall, Jr.
3,656,864 A 4/1972 Wagle
3,701,536 A 10/1972 Matthews et al.
3,846,899 A 11/1974 Gross
4,088,422 A 5/1978 Martin
5,232,339 A * 8/1993 Plemmons et al. ..... 415/178
5,785,492 A 7/1998 Belsom et al.
5,932,356 A 8/1999 Sileo et al.
5,984,314 A 11/1999 Peters et al.
6,190,124 B1 * 2/2001 Freling et al. ..... 415/173.4
7,470,113 B2 12/2008 Tran et al.

* cited by examiner

*Primary Examiner* — Christopher Verdier
*Assistant Examiner* — Jason Davis
(74) *Attorney, Agent, or Firm* — O'Shea Getz P.C.

(57) ABSTRACT

A seal assembly for a gas turbine engine is provided that includes a seal support member, at least one knife edge seal blade member, and at least one cooling member. The seal support member is configured for rotation within the gas turbine engine around an axial centerline of the engine. The support member has a thickness extending between a first surface and a second surface. The blade member extends outwardly from the first surface of the support member. The blade member has a central portion that extends between a base end and a distal knife edge end. The base end is attached to the first surface of the seal support member. The cooling member extends outwardly from the second surface, and is oppositely aligned with the blade member.

17 Claims, 2 Drawing Sheets

KNIFE EDGE SEAL ASSEMBLY

BACKGROUND OF THE INVENTION

1. Technical Field

This disclosure relates generally to knife edge seals and, more particularly, to reducing thermal gradients within knife edge seals.

2. Background Information

Gas turbine engines include a plurality of rotor stages within both the compressor and the turbine. The rotor stages are alternately disposed with stator stages. A variety of different seal types may be used between the stages to maintain separation between high temperature core gas and lower temperature cooling gas. One type of seal often used between rotor and stator stages is a knife edge seal that includes a rotary knife edge portion and a stationary sealing land. The knife edge portion is configured to contact or be positioned in close proximity to the seal land. The knife edge portion is typically a ring-like structure with a pointed distal end and a base end that is attached to a support structure. The sealing land is typically an abradable hoop like structure having a width, which can accommodate some amount or incursion by the knife-edge portion. Knife edge seals are typically deployed to restrict fluid leakage between a region containing cooling air and an internal region containing core gas (i.e., gas that has been compressed and may include combustion products if located within the turbine).

During operation of a gas turbine engine, it is common for there to be abrupt accelerations and de-accelerations of the rotational speed of the engine. As a result, portions of the engine may be subject to relatively large transient thermal variances, resulting in different transient thermal growth patterns. For example, during a rapid acceleration, the knife edge portion of a knife edge seal can be quickly heated, relatively speaking, by an airflow traveling through the gas path. The relatively quick expansion of the knife edge portion that accompanies the increase in temperature can create significant amounts of compressive stress within the knife edge portion. The base portion of the seal, in contrast, stays relatively cool for an amount of time because the base portion is not surrounded by the same thermal input as the knife edge portion; e.g., the base portion is proximate the cooling air disposed within the internal cavity. Over time, however, the base portion and the knife edge portion can arrive at a steady-state condition if the operation of the engine remains steady-state. Conversely, if an engine decelerates from a steady-state condition, the knife edge portion may be subject to cooler core air than was present under the steady-state conditions. As a result, the knife edge portion can be exposed to another thermal variance relative to the base, wherein the knife edge portion cools more rapidly than the base portion. The relatively quick contraction of the knife edge portion that accompanies the decrease in temperature can create a significant amount of tensile stress within the knife edge portion. The stresses created by the thermal cycling can negatively affect the life expectancy of the seal.

SUMMARY OF THE DISCLOSURE

According to an aspect of the present invention, a seal assembly for a gas turbine engine is provided that includes a seal support member, at least one knife edge seal blade member, and at least one cooling member. The seal support member is configured for rotation within the gas turbine engine around an axial centerline of the engine. The support member has a thickness extending between a first surface and a second surface. The blade member extends outwardly from the first surface of the support member. The blade member has a central portion that extends between a base end and a distal knife edge end. The base end is attached to the first surface of the seal support member. The cooling member extends outwardly from the second surface, and is oppositely aligned with the blade member.

According to another aspect of the present invention, a rotor assembly for a gas turbine engine is provided that includes a rotor stage, a seal support member, a knife edge seal blade member, and a cooling fin. The seal support member extends laterally outwardly from the rotor. The support member includes a thickness extending between a first surface and a second surface. The blade member extends outwardly from the first surface. The cooling fin extends outwardly from the second surface, and is oppositely aligned with the blade member.

DETAILED DESCRIPTION OF THE INVENTION

Figure 1:
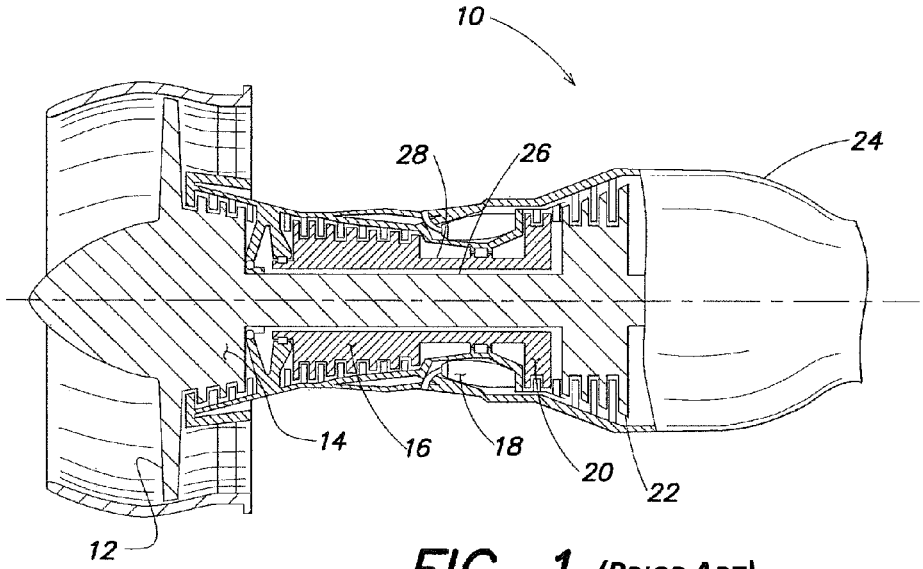
FIG. 1 (PRIOR ART)
FIG. 1 is a diagrammatic illustration of a gas turbine engine.

Now referring to FIG. 1, a gas turbine engine 10 is shown having a fan 12, a low pressure compressor 14, a high pressure compressor 16, a combustor 18, a high pressure turbine 20, a low pressure turbine 22, and a nozzle 24. The fan 12, low pressure compressor 14, and low pressure turbine 22 are connected to one another by a low pressure shaft 26. The high pressure compressor 16 and high pressure turbine 20 are connected to one another by a high pressure shaft 28. The compressor and turbine sections 14, 16, 20, 22 each contain multiple rotor and stator stages. The gas turbine engine 10 shown is an example of a gas turbine engine embodiment in which the present invention can be used, but the present invention is not limited thereto.

Figure 2:
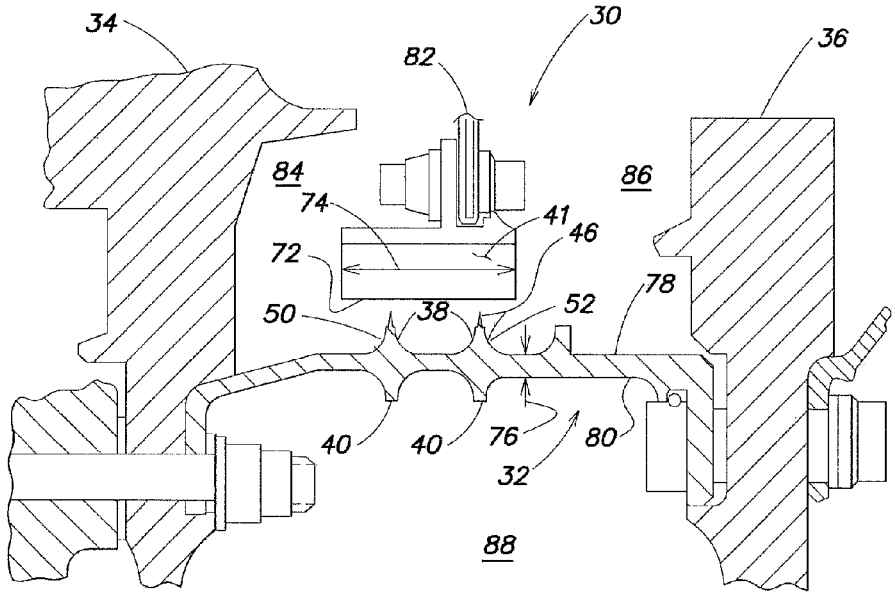
FIG. 2 is a partial diagrammatic illustration of an embodiment of a present invention seal assembly.
Figure 3:
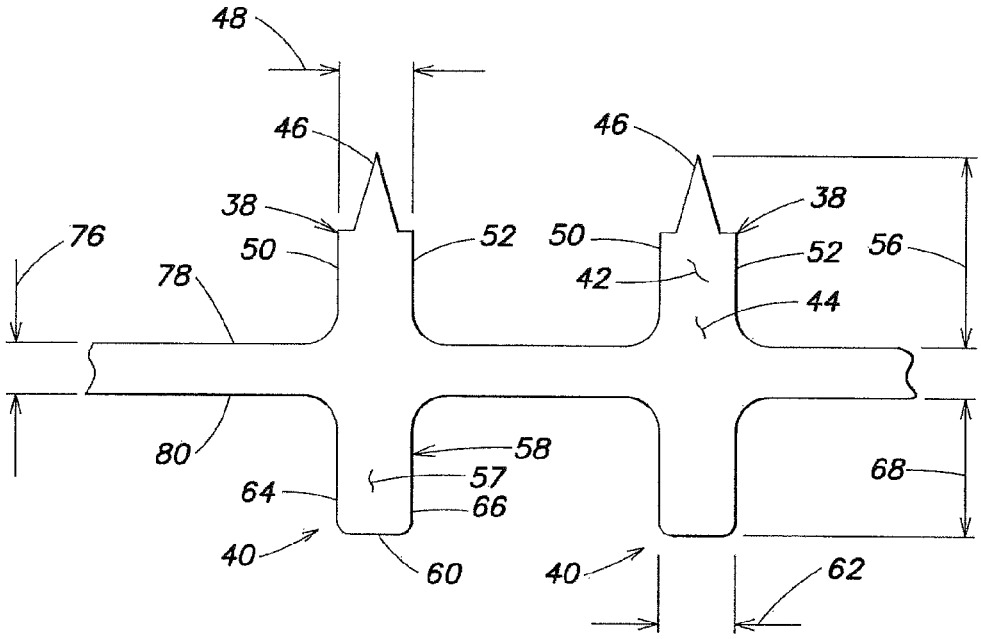
FIG. 3 is an enlarged view of a portion of the present invention seal assembly shown in FIG. 2.

Now referring to FIGS. 2 and 3, a knife edge seal assembly 30 is shown with a support member 32 extending between two rotor stages 34, 36. The seal assembly 30 can be used in compressor and turbine sections 14, 16, 20, 22. The configuration shown in FIG. 2 is an example of how the present invention seal assembly 30 can be implemented. The present invention is not, however, limited to this particular embodiment.

The seal assembly 30 includes at least one blade member 38, at least one cooling fin 40, and a seal pad 41. The blade member 38 and cooling fin 40 are part of a circumferentially extending ring that may be a unitary piece or a plurality of sections that can be combined to form a ring. In the embodiment shown in FIG. 2, the blade members 38 and cooling fins 40 are integrally attached to one another as a unitary body. In other embodiments, the blade members 38 and cooling fins 40 may be formed independent of one another and joined to form the ring structure.

Referring to FIG. 3, a cross-section of the blade member 38 shows that the blade member 38 includes a center section 42 extending between a base end 44 and a distal knife edge end 46. The blade member 38 has a width 48 that extends between a forward lateral side 50 and an aft lateral side 52. The Knife edge end 46 typically has a point configuration. Each blade member 38 has a height 56 that extends between the base end 44 and the knife edge end 46. The blade member 38 has a total surface area that includes the forward lateral surface area and the aft lateral surface area, each of which areas extend from the base end 44 to the knife edge end 46.

A cross-section of the cooling fin 40 shows that the cooling fin 40 includes a center section 57 extending between a base end 58 and a distal end 60. The fin 40 has a width 62 that extends between a forward lateral side 64 and an aft lateral side 66. Each cooling fin 40 has a height 68 that extends between the base end 58 and the distal end 60. The cooling fin 40 has a total surface area that includes the surface area of each lateral side, from the base end 58 to the distal end 60.

The seal pad 41 is a circumferentially extending hoop that has a seal surface 72 and a width 74. The seal pad 41 may be a unitary structure or may be a plurality of sections combined to form a hoop. The width 74 of the seal surface is great enough to ensure the seal pad 41 is aligned with the one or more blade members 38 in the event of axial movement of one or both of the seal pad 41 and the blade members 38 relative to the other during operation of the engine 10. Knife edge seal pads are known in the art, and the present invention is not limited to any particular embodiment. A seal pad 41 made from a material that abrades upon contact with a blade member 38 is an example of an acceptable seal pad.

The seal support member 32 shown in FIG. 2 is a circumferentially extending hoop structure that extends between adjacent rotor stages 34, 36. The support member 32 has a thickness 76 that extends between a first side surface 78 and a second side surface 80. The present invention is not limited to the seal support member embodiment shown in FIG. 2.

The base end 44 of each blade member 38 is attached to the seal support member 32 on the first side surface 78 of the seal support member 32, and the blade members 38 extend outwardly from the first side surface 78. The base end 58 of each cooling fin 40 is attached to the seal support member 32 on the second side surface 80 of the seal support member 32, and the cooling fins 40 extend outwardly from the second side surface 80. Each blade member 38 and cooling fin 40 is aligned with the other on opposite sides of the support member 32. In those embodiments having a plurality of blade members 38, there is an equal number of cooling fins 40. The blade members 38 and cooling fins 40 are aligned as pairs; i.e., each blade member 38 has a paired cooling fin 40 aligned on the opposite side of the support member 32.

In the embodiment of the seal assembly 30 shown in FIGS. 2 and 3, the geometry of each cooling fin 40 is similar to that of the blade member 38 extending out from the opposite side of the support member 32. For example, the blade member 38 and the aligned cooling fin 40 have approximately the same height and width. The present invention does not require that the geometry of the cooling fin 40 be the same as the paired blade member 38, however. In fact, in some applications, space or other constraints may make it impractical to have a blade member 38 and an aligned cooling fin 40 with the same geometries. In such instances, benefits provided by a cooling fin can be gained by utilizing a cooling fin having a height that is less or more than the height of the aligned blade member. The range of ratios of cooling fin height versus blade member height that can be used to provide the described function under the present invention is approximately 0.5:1.0 to 1.5:1.0 (CFH:BMH). Alternatively, under certain circumstances, benefits provided by a cooling fin can be gained by utilizing a cooling fin having a width that is less or more than the width of the aligned blade member. The range of ratios of cooling fin width versus blade member width that can be used to provide the described function under the present invention is approximately 0.5:1.0 to 1.5:1.0 (CFW:BMW).

In some embodiments, a portion or all of each blade member 38 is coated with a thermal barrier coating such as, but not limited to, zirconium oxide. The thermal barrier inhibits heat transfer to the blade member 38.

In the application embodiment shown in FIG. 2, the knife edge seal assembly 30 is disposed proximate a stator stage 82 positioned between two rotor stages 34, 36 to inhibit the flow of core gas along a path that extends outside of the working region of the stator stage 82 (i.e., between the vanes). In the embodiment shown in FIG. 2, the seal support member 32 extends between the first rotor stage 34 and the second rotor stage 36. The side of the support member 78 bearing the blade members 38 is exposed to a pair of regions 84, 86 containing gas flowing through the core of the engine 10, separated from one another by the blade members 38 of the knife edge seal assembly 30. The region disposed on the upstream side of the knife edge seal assembly 30 may be referred to as the forward core gas region 84, and the region on the opposite (or downstream) side of the knife edge seal assembly 30 may be referred to as the aft core gas region 86. The side of the support member 80 bearing the cooling fins 40 is exposed to a region 88 containing cooling gas flow, which flow is at a lower temperature than the core gas flow. The knife edge ends 46 of the blade members 38 are disposed in close proximity, or in contact with the seal pad 41.

Core gas traveling within the forward and aft core gas regions 84, 86 contacts the forward and aft lateral surface areas of the blade members 38. Heat transfer from the core gas to the blade member 38 within the core gas regions 84, 86 occurs by both conduction and convection. The rate of heat transfer from the core gas to the blade member 38 is a function of surface area. The rate of which portions of the blade member 38 arrive at particular temperatures is a function of the geometry of the blade member 38. For example, the knife edge end 46 of the blade member 38 will reach temperature parity with the core flow before the rest of the blade member 38 because it is thinner than the rest of the blade member 38. Heat transfer from the cooling gas to the cooling fins 40 disposed within the cooling gas region 88 occurs by both conduction and convection.

Figure 4:
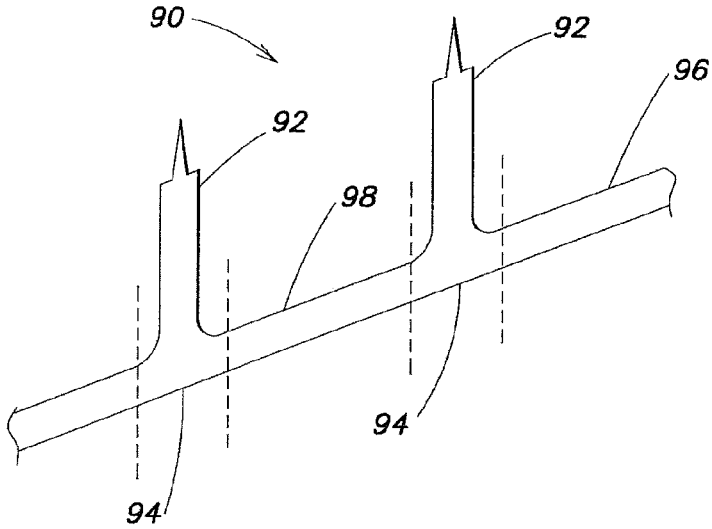
FIG. 4 (PRIOR ART)
FIG. 4 is a knife edge seal assembly without a cooling member.

FIG. 4 shows an embodiment of a knife edge seal 90 that does not include an opposed cooling fin. It can be readily seen that each blade member 92 of the knife edge seal 90 has a substantially greater amount of surface area than the region 94 of the support member 96 aligned with that blade member 92 (aligned area shown between dashed lines). As a result, the blade members 92 are exposed to substantially more core gas flow than cooling air flow and the heat transfer that is associated therewith. The embodiment of the present invention seal assembly 30 shown in FIGS. 2 and 3, in contrast, has aligned cooling fins 40 that have approximately the same amount of surface area as the blade members 38. As a result, the blade members 38 and cooling fins 40 have approximately the same amount of surface area exposed to air flow and the heat transfer that is associated therewith. The present invention does not require that a paired blade member 38 and cooling fin 40 have the same amount of total surface area, however. In some applications, space or other constraints may make it impractical to have a blade member 38 and an aligned cooling fin 40 with equal total surface areas. In such instances, benefits provided by a cooling fin can be gained in part by utilizing a cooling fin having a total surface area that is at least one-half the total surface area of the aligned blade member. In other embodiments, the cooling fin may have more surface area (e.g., up to one and one-half times) than the total amount of surface area of the aligned blade member. Hence, the range of ratios of cooling fin total surface area versus blade member total surface area is approximately 0.5:1.0 to 1.5:1.0 (CFT-SA:BMTSA) under the present invention.

During a rapid acceleration of the engine 10 from an idle or steady-state condition, the temperature of the core gas flow will substantially increase in a relatively short period of time. Heat transfer from the higher temperature core gas flow will occur over substantially all of the exposed surface area of the blade members 38. The rapid increase in temperature will create a temperature gradient along the height of the blade members 38. The temperature gradient, in turn, will cause differences in thermal expansion between sections of the blade members 38, which differences will create mechanical stress within the blade members 38. The amount and type of stress produced will depend on the differences in temperature and the position on the blade member 38. The knife edge end 46 of a blade member 38 can, for example, be subject to considerable compressive hoop stress when the blade member 38 is subjected to a rapid increase in temperature. If the stress is great enough to create plastic deformation, the blade member 38 can be permanently altered.

During a rapid deceleration of the engine 10, the temperature of the core gas flow will substantially decrease in a relatively short period of time. Heat transfer from the lower temperature core gas flow will occur over substantially all of the exposed surface area of the blade members 38. The rapid decrease in temperature will create a temperature gradient along the height of the blade members 38. The temperature gradient, in turn, will cause differences in thermal contraction between sections of the blade members 38, which differences will create mechanical stress within the blade members 38. The amount and type of stress produced will depend on the differences in temperature and the position on the blade member 38. The knife edge end 46 of a blade member 38 can, for example, be subject to considerable tensile hoop stress when the blade member 38 is subjected to a rapid decrease in temperature.

To alleviate the stress, the present invention includes a cooling fin 40 aligned with each blade member 38. The cooling fins 40 extend out into the cooling air traveling within the internal region of the engine 10. The cooling fins 40 provide an increased amount of surface area (compared to embodiments without cooling fins 40) through which heat transfer can take place with the cooling air. As a result, thermal energy is drawn out of the aligned blade members 38. Without the cooling fin 40 (e.g., the embodiment shown in FIG. 4), thermal energy within each blade member 92 is restricted to traveling from the blade 92 to the support member 96. The first surface 98 of the support member 96, however, is also subjected to the core gas temperature. Consequently, there is limited impetus for thermal energy to travel laterally within the support member 96. In the absence of a cooling fin, the region 94 aligned with the blade member 92 provides a limited amount of surface area through which heat transfer can take place. Using the present invention (e.g., as shown in FIGS. 2 and 3), however, the cooling fin 40 provides an increased amount of heat transfer surface, which surface is entirely exposed to lower temperature cooling air. Analytical studies indicate that a cooling fin 40 having an amount of surface area that is approximately equal to or greater than the amount of surface area of the aligned blade member 38 results in a desirable amount of heat transfer. The embodiment shown in FIGS. 2 and 3 illustrates an example of cooling fins 40 having a geometry (e.g., height and width) that is approximately the same as the aligned blade member 38. The alignment of the cooling fin 40 with the blade member 38 facilitates the transfer of thermal energy because it minimizes the length of the conductive path.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents. For example, the present invention is described above as having a cooling fin 40 aligned with each blade member 38. In alternative embodiments, other heat transfer means could be used in place of the cooling fins 40; e.g., cooling pins, etc.

What is claimed is:

1. A seal assembly for a gas turbine engine, comprising:

a seal support member configured for rotation within the gas turbine engine around an axial centerline of the engine, wherein the support member has a thickness extending between a first surface and a second surface;

at least one knife edge seal blade member extending outwardly from the first surface, wherein the blade member includes a central portion extending between a base end and a distal knife edge end, and wherein the base end is attached to the first surface of the seal support member; and at least one cooling fin extending outwardly from the second surface, and oppositely aligned with the blade member;

wherein the at least one cooling fin comprises a cooling fin width that extends between a first cooling fin side and a second cooling fin side, and a cooling fin height that extends outwardly from the second surface to a cooling fin distal end; and wherein the cooling fin height is greater than the cooling fin width.

2. The seal assembly of claim 1, wherein the distal knife edge end of the knife edge seal is configured to form a seal with a non-rotating seal land.

3. The seal assembly of claim 1, wherein the blade member has a width greater than or equal to a width of the cooling fin.

4. The seal assembly of claim 1, wherein the cooling fin has a total amount of surface area greater than or equal to a total amount of surface area of the blade member.

5. The seal assembly of claim 1, wherein cooling fin has a height greater to or equal to a height of the blade member.

6. The seal assembly of claim 1, wherein the blade member and the cooling fin are integrally formed with the support member.

7. The seal assembly of claim 1, further comprising a thermal barrier coating disposed on the blade member.

8. The seal assembly of claim 1, wherein the cooling fin has a width and the blade member has a width, and the widths are in the range of approximately 0.5:1.0, cooling fin width to blade member width, to 1.5:1.0 cooling fin width to blade member width.

9. The seal assembly of claim 1, wherein the cooling fin has a height and the blade member has a height, and the heights are in the range of approximately 0.5:1.0, cooling fin height to blade member height, to 1.5:1.0 cooling fin height to blade member height.

10. A rotor assembly for a gas turbine engine having an axially extending centerline, comprising:

a rotor stage rotatable around the axially extending centerline;

a seal support member extending laterally outwardly from the rotor, wherein the support member includes a thickness extending between a first surface and a second surface;

at least one knife edge seal blade member extending outwardly from the first surface; and at least one cooling fin extending outwardly from the second surface, and oppositely aligned with the blade member;

wherein the at least one cooling fin comprises a cooling fin width that extends between a first cooling fin side and a second cooling fin side, and a cooling fin height that extends outwardly from the second surface to a cooling fin distal end; and wherein the cooling fin height is greater than the cooling fin width.

11. The rotor assembly of claim 10, wherein the blade member includes a distal knife edge end which is configured to form a seal with a non-rotating seal land.

12. The rotor assembly of claim 10, wherein the blade member has a width greater than or equal to a width of the cooling fin.

13. The rotor assembly of claim 10, wherein the cooling fin has a total amount of surface area greater than or equal to a total amount of surface area of the blade member.

14. The rotor assembly of claim 10, wherein cooling fin has a height greater to or equal to a height of the blade member.

15. The rotor assembly of claim 10, wherein the blade member and the cooling fin are integrally formed with the support member.

16. The rotor assembly of claim 10, further comprising a thermal barrier coating disposed on the blade member.

17. A seal assembly for a gas turbine engine, comprising:

a seal support member configured for rotation within the gas turbine engine around an axial centerline of the engine, wherein the support member has a thickness extending between a first surface and a second surface;

at least one knife edge seal blade member extending outwardly from the first surface, wherein the black member includes a central portion extending between a base end and a distal knife edge end, and wherein the base end is attached to the first surface of the seal support member; and a cooling member extending outwardly from the second surface, and oppositely aligned with the blade member;

wherein the cooling member comprises a cooling member width that extends between a first cooling member side and a second cooling member side, and a cooling member height that extends outwardly from the second surface to a cooling member distal end; and wherein the cooling member height is greater than the cooling member width.

* * * * *